US007213421B2

(12) United States Patent
Shirasaki et al.

(10) Patent No.: US 7,213,421 B2
(45) Date of Patent: May 8, 2007

(54) THREE-DIMENSIONALLY CONSTRUCTED WARP KNIT FABRIC WITH SLIPPAGE-PREVENTIVE YARNS

(75) Inventors: Fumio Shirasaki, Fukui (JP); Yukito Kaneko, Fukui (JP)

(73) Assignee: Seiren Co., Ltd., Fukui-shi, Fukui (JP)

( * ) Notice: Subject to any disclaimer, the term of this patent is extended or adjusted under 35 U.S.C. 154(b) by 0 days.

(21) Appl. No.: 10/550,803

(22) PCT Filed: Mar. 29, 2004

(86) PCT No.: PCT/JP2004/004449

§ 371 (c)(1),
(2), (4) Date: Sep. 22, 2005

(87) PCT Pub. No.: WO2004/088020

PCT Pub. Date: Oct. 14, 2004

(65) Prior Publication Data

US 2006/0185401 A1 Aug. 24, 2006

(30) Foreign Application Priority Data

Mar. 31, 2003 (JP) ..... 2003-096726

(51) Int. Cl.
*D04B 9/06* (2006.01)

(52) U.S. Cl. ..... 66/193; 66/195; 66/196

(58) Field of Classification Search ..... 66/195, 66/193, 202, 190–192, 196
See application file for complete search history.

(56) References Cited

U.S. PATENT DOCUMENTS

| | | | | |
|---|---|---|---|---|
| 3,646,782 | A * | 3/1972 | Kohl | 66/87 |
| 4,787,219 | A | 11/1988 | Sato et al. | |
| 5,385,036 | A * | 1/1995 | Spillane et al. | 66/87 |
| 6,105,401 | A * | 8/2000 | Chadeyron et al. | 66/195 |
| 6,477,865 | B1 * | 11/2002 | Matsumoto | 66/195 |
| 6,755,052 | B1 * | 6/2004 | Sytz | 66/196 |
| 2002/0157429 | A1 | 10/2002 | Matsumoto | |

FOREIGN PATENT DOCUMENTS

| | | |
|---|---|---|
| JP | 62-45759 | 2/1987 |
| JP | 2003-3354 | 1/2003 |
| WO | WO 01/00914 A1 | 1/2001 |
| WO | WO 01/44551 A1 | 6/2001 |

* cited by examiner

*Primary Examiner*—Danny Worrell
(74) *Attorney, Agent, or Firm*—Flynn, Thiel, Boutell & Tanis, P.C.

(57) ABSTRACT

A three-dimensionally constructed warp knit fabric formed to include front-surface and back-surface ground knit constructions and connection yarns interconnecting the front-surface and back-surface ground knit constructions has insertion yarns between the connection yarns, in which the insertion yarn is fixed along the inner side of the back-surface ground knit construction. Further, the insertion yarn is fixed by a fixing yarn to the back-surface ground knit construction.

5 Claims, 11 Drawing Sheets

THREE-DIMENSIONALLY CONSTRUCTED WARP KNIT FABRIC WITH SLIPPAGE-PREVENTIVE YARNS

TECHNICAL FIELD

The present invention relates to a three-dimensionally constructed warp knit fabric used as a material, such as a cushion material and a filler material, in clothing fields; and more particularly, as a material such as a vehicle seat material in industrial material fields. More specifically, the present invention relates to a three-dimensionally constructed warp knit fabric that has pressure resistance and compressive elasticity, that is composed of primary constructional members inclusive of a front-surface ground knit construction and a back-surface ground knit construction, connection yarns interconnecting these constructions, and insertion yarns fixed between the connection yarns, and that has the capability of effectively preventing slippage between the ground knit constructions.

BACKGROUND ART

Hitherto, various proposals have been made regarding three-dimensionally constructed warp knit fabrics formed of a front-surface ground knit construction, a back-surface ground knit construction, and connection yarns interconnecting these constructions.

These three-dimensionally constructed warp knit fabrics are formed primarily such that textile materials are knitted by using a knitting machine with double-row needle carriers.

Connection yarns include those of, for example, a type having orthogonal connection yarns used for interconnection substantially in an orthogonal state with respect to front-surface and back-surface ground knit constructions, a type having oblique connection yarns used for interconnection substantially in an oblique state with respect to front-surface and back-surface side sections, a type of a truss structure having both orthogonal and oblique connection yarns.

For these conventional three-dimensionally constructed warp knit fabrics, key points are to find out an orthogonal state that should be used to enhance the pressure resistance of front-surface and back-surface ground knit constructions of the connection yarns. More specifically, the key points are to find out a type of the truss structure of the connection yarns should be formed to prevent slippage the constructions, and how to enable the prevention of slippage between front-surface and back-surface ground construction to be attained and concurrently to obtain the pressure resistance of the ground knit constructions, or the type of materials should be used for connection yarns to obtain the pressure resistance of the ground knit constructions.

However, for these conventional three-dimensionally constructed warp knit fabrics, the above-described means, which places importance on the pressure resistance to obtain the compressive elasticity thereof, greatly relies on the means that employs the truss structure, uses connection yarns with higher elasticity, and especially, uses the connection yarns with high density.

As such, problems take place in that when pressure is applied, the high elasticity connection yarns are bent and entangled with one another, whereby the compressive elasticity is deteriorated.

In addition, in a case where net constructions are employed for both or any one of the front-surface and back-surface ground knit constructions, the connection yarns overextend from open portions of the net constructions, the wearing is caused from the outside, the nap is thereby caused on the overextended portions.

This causes obnoxious feeling to be provided in use and causes the appearance to deteriorate.

Known knit fabrics that solve problems such as those described above include a three-dimensional knit fabric that includes a front-surface ground knit construction and a back-surface ground knit construction, connection yarns for interconnecting the front-surface and back-surface ground knit constructions, pluralities of warp insertion yarns and/or weft insertion yarns parallelly inserted between the connection yarns, wherein at least one lay of the warp insertion yarns form a knit construction in interengagement with the warp insertion yarns. (Refer to Patent Reference Document 1).

According to this method, however, since the plurality of insertion yarns are used, not only cloth is formed to be thick with texture mass being increased, but also flexibility of the cloth is impaired.

In addition, since the plurality of insertion yarns are used, insertion yarns are knitted in proximity with one another or are congested with one another depending on the use condition whereby disabling the connection yarns to be bound.

As a result, the pressure resistance, the inter-ground knit construction slippage preventability, and the like are not necessarily sufficiently improved.

(Patent Reference Document 1) Japanese Unexamined Patent Application Publication No. 62-45760

DISCLOSURE OF INVENTION

The present invention is made to solve the problems described above.

More specifically, an object of the present invention is to secure a three-dimensionally constructed warp knit fabric excellent in pressure resistance and inter-ground knit construction slippage preventability without impairing cloth flexibility and the like.

In order to solve the problems described above, in making the present invention, it has been discovered that in addition to the constructional members as observed in the conventional three-dimensionally constructed warp knit fabric, namely the front-surface ground knit construction, the back-surface ground knit construction, and the connection yarns, insertion yarns, are fixed along an inner side of the ground knit construction, whereby bending and congestion occurrences, for example, when the construction is compressed can be prevented as many as possible, elasticity deterioration can be prevented, and inter-ground knit construction slippage can be effectively prevented without impairing cloth flexibility. Consequently, the present invention has been accomplished.

The present invention provides the following.

(1) A three-dimensionally constructed warp knit fabric formed to include two front-surface and back-surface ground knit constructions and connection yarns interconnecting the front-surface and back-surface ground knit constructions characterized by comprising insertion yarns between the connection yarns, wherein the insertion yarn is fixed along the inner side of the back-surface ground knit construction.

(2) The three-dimensionally constructed warp knit fabric characterized in that the insertion yarn is fixed by a fixing yarn to the back-surface ground knit construction.

(3) The three-dimensionally constructed warp knit fabric characterized in that the insertion yarn is inserted in a course direction and/or a wale direction.

(4) The three-dimensionally constructed warp knit fabric characterized in that in a portion where the insertion yarn is fixed by a fixing yarn, the number of overlapped insertion yarns is 2–6, a total fineness all of the overlapped insertion yarns is 334–8400 dtex.

(5) The three-dimensionally constructed warp knit fabric is characterized in that an insertion density of the insertion yarns, shown by expression 1, is 0.006–0.4 g/cm$^3$, wherein $$\text{insertion density}=S/10000T \quad (1)$$

where

S: amount of insertion yarn usage per 1 m$^2$ (g), and

T: thickness of the three-dimensionally constructed warp knit fabric (cm).

(6) A manufacturing method for a three-dimensional warp knit formed to include two front-surface and back-surface ground knit constructions and connection yarns interconnecting the two front-surface and back-surface ground knit constructions is characterized in that the insertion yarns are inserted between the connection yarns, and the insertion yarn is fixed by fixing yarns along the inner side of the back-surface ground knit construction.

REFERENCE NUMERALS

Figure 1:
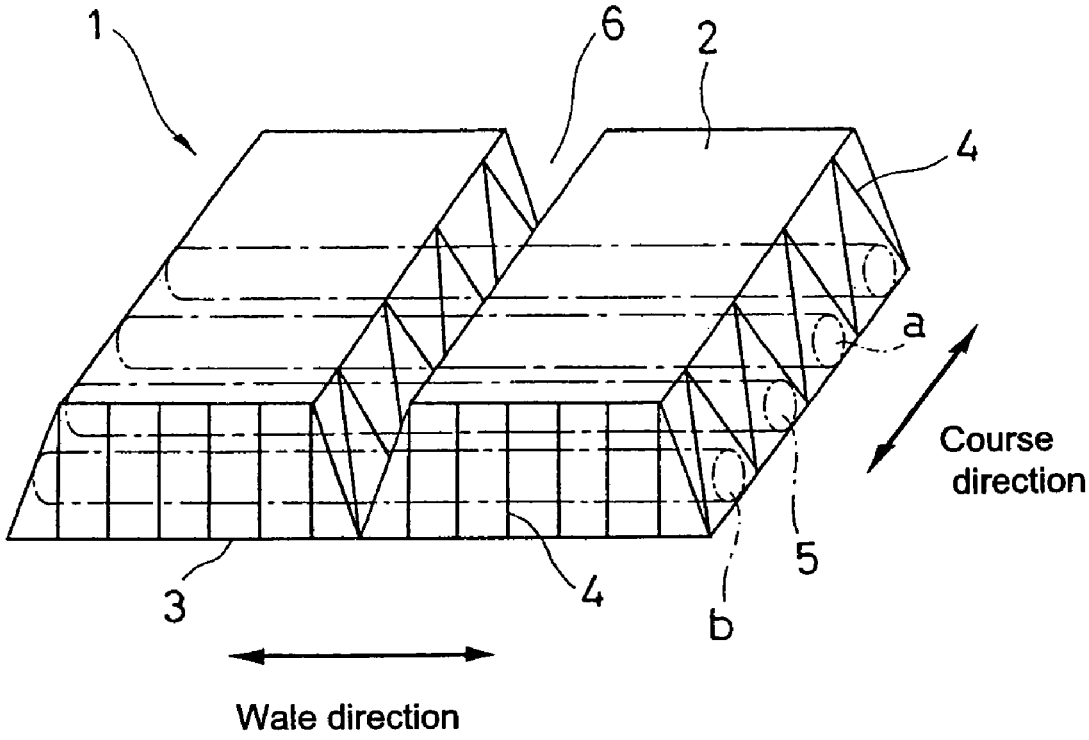
FIG. 1 is a schematic perspective view schematically showing a three-dimensionally constructed warp knit fabric.

1 three-dimensionally constructed warp knit fabric
2 front-surface ground knit construction
3 back-surface ground knit construction
4 connection yarn
5 insertion yarns
6 open portion
A1, A5, A6 ground yarn
A2 insertion yarn
A3 connection yarn
A4 fixing yarn The present invention may have a combined construction of two or more ones selected from items 1 to 6 described above, as long as it satisfies the object.

BEST MODE FOR CARRYING OUT THE INVENTION

A three-dimensionally constructed warp knit fabric of the present invention is composed of primary constructional members inclusive of front-surface and back-surface ground knit constructions, connection yarns interconnecting the front-surface and back-surface ground knit constructions, and insertion yarns fixedly held between the connection yarns along inner portions of ground knit constructions.

The three-dimensionally constructed warp knit fabric has characteristics in that it has optimal pressure resistance (compression resistance) and compressive elasticity, is capable of effectively preventing slippage between the ground knit constructions in a course direction and/or a wale direction, and does not cause deterioration in flexibility.

Figure 11:
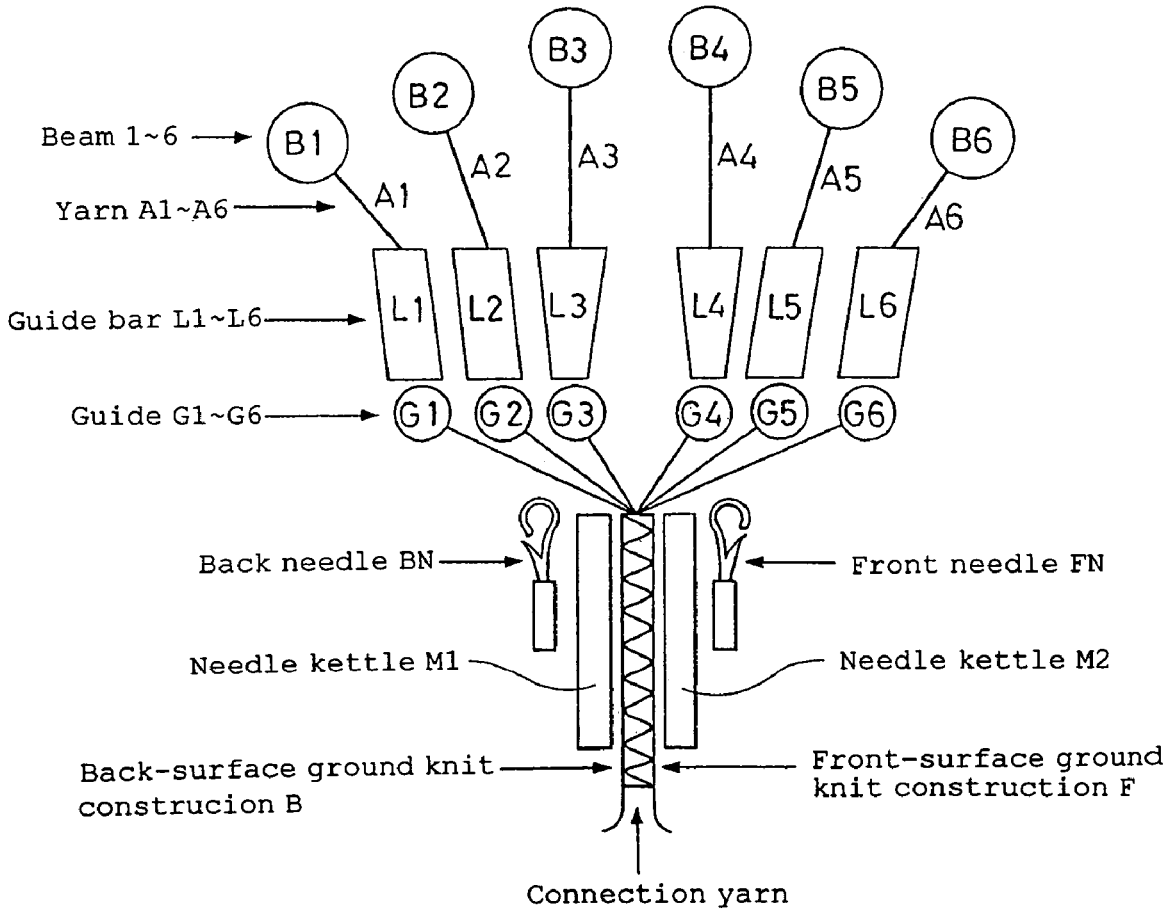
FIG. 11 is a schematic view showing an essential knit portion of a double-row needle carrier warp knitting machine (double raschel machine).

Referring to FIG. 11, the three-dimensionally constructed warp knit fabric can be obtained by being knitted using a double-row needle carrier warp knitting machine (double raschel machine).

A ground yarn A1 is supplied to a guide bar L-1 (represented by "L1" in FIG. 11), and a back-surface ground knit construction B is formed by a back needle BN.

An insertion yarn A2 is supplied to a guide bar L-2, is guided by the back needle BN along the inner portion of the back-surface ground knit construction B, and is then fixed by a fixing yarn A4.

Ground yarns A5 and A6 are supplied to guide bars L-5 and L-6, respectively, and a front-surface ground knit construction F is formed by a front needle FN.

A connection yarn A3 is guided by a guide bar L-3 to the front needle FN and the back needle BN, and is sequentially knitted into the front-surface ground knit construction F and the back-surface ground knit construction B to interconnect the two constructions.

A fixing yarn A4 is guided by a guide bar L-4 to the front needle FN, is knitted to fix the insertion yarn A3, and is sequentially knitted into the back-surface ground knit construction B.

Figure 4:
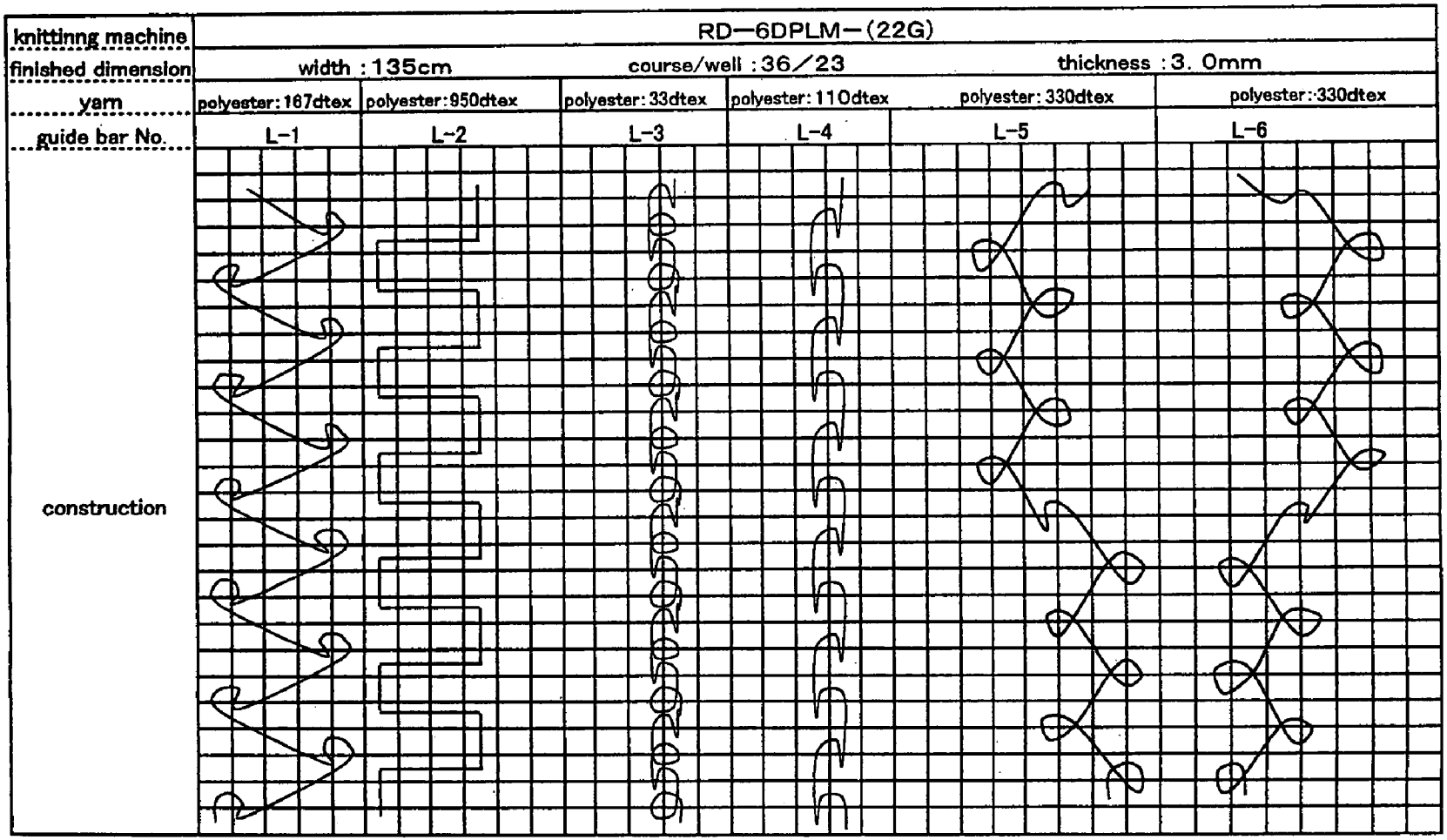
FIG. 4 is a construction view of a three-dimensionally constructed warp knit fabric of Example 1.
Figure 5:
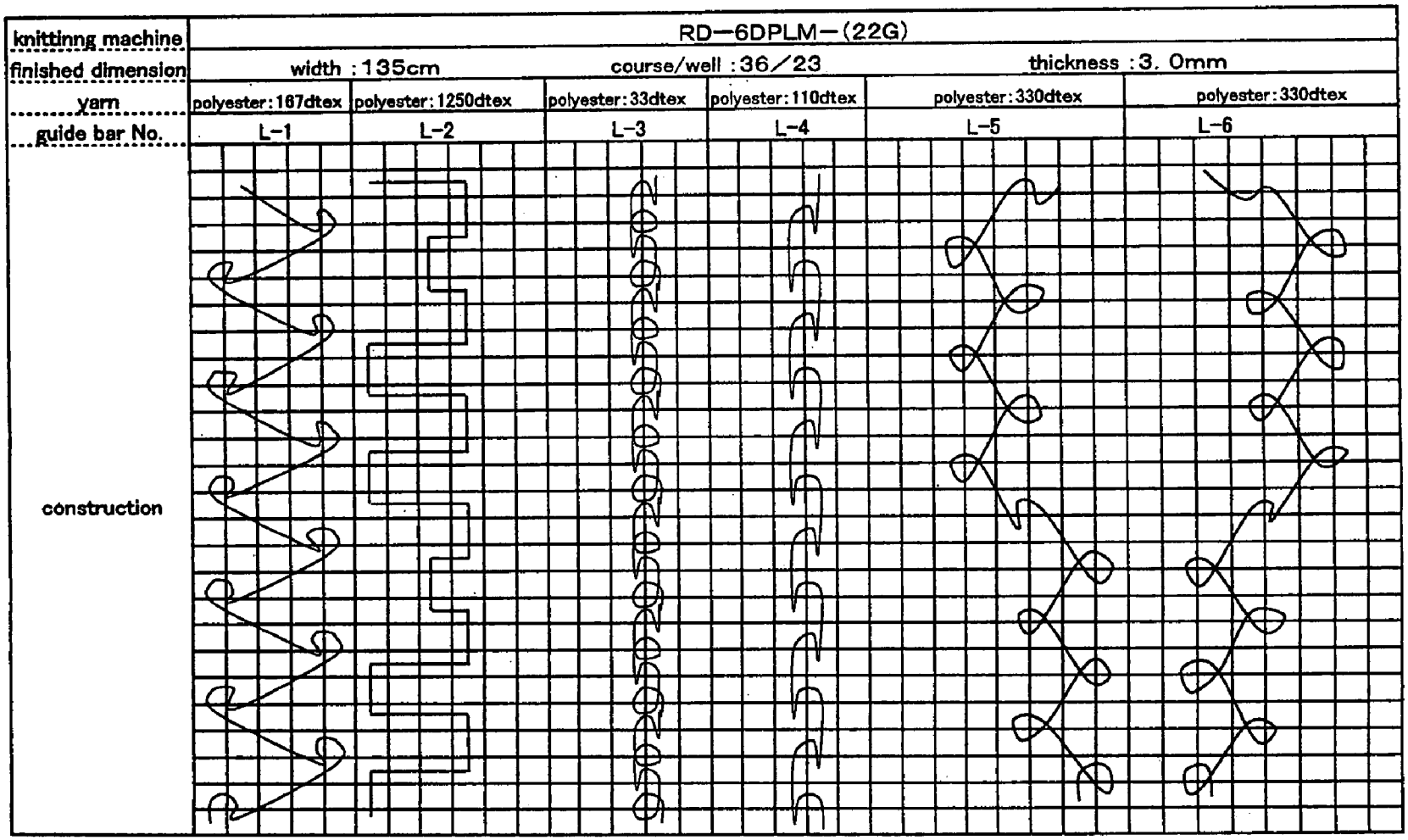
FIG. 5 is a construction view of a three-dimensionally constructed warp knit fabric of Example 2.
Figure 6:
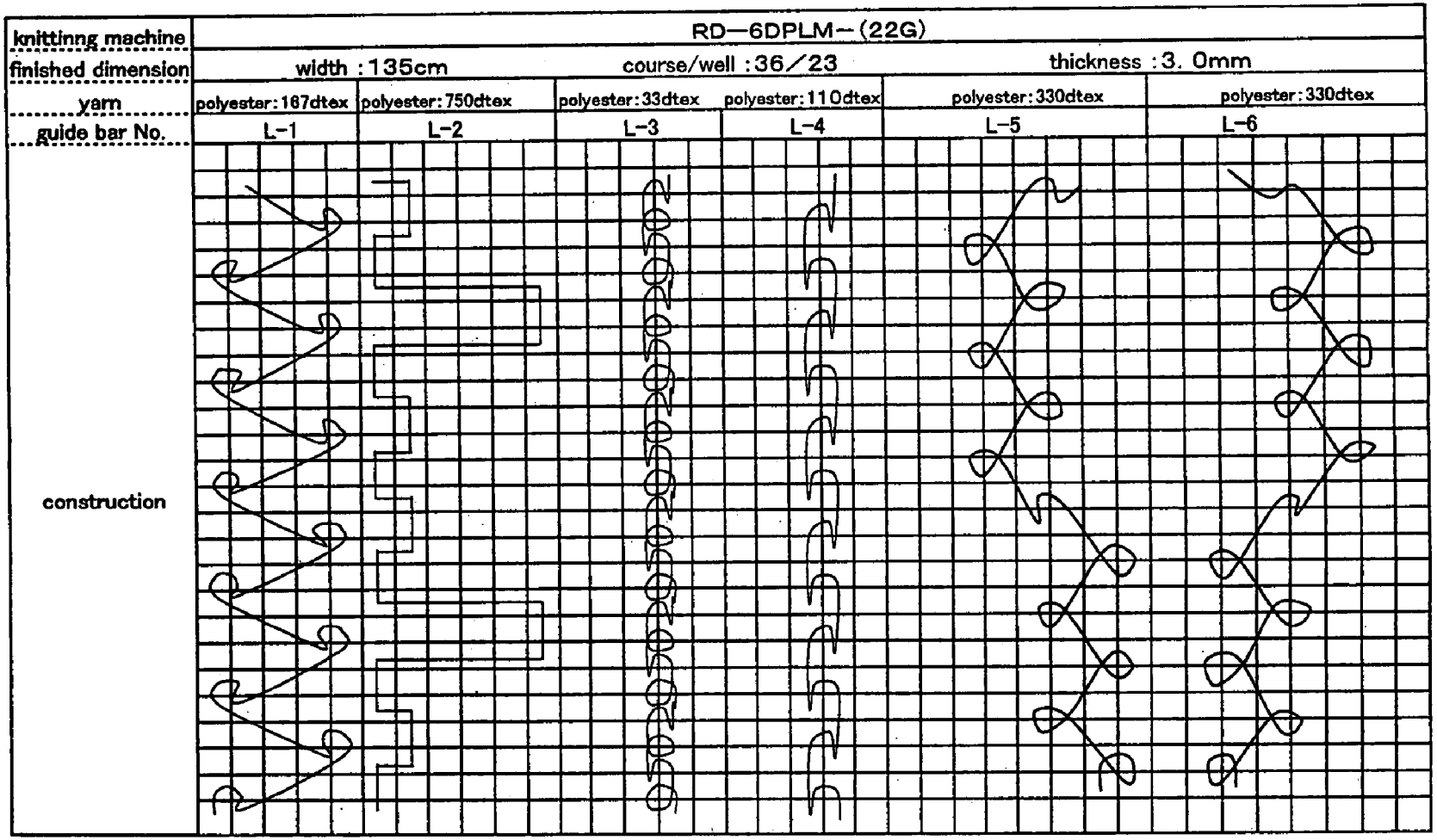
FIG. 6 is a construction view of a three-dimensionally constructed warp knit fabric of Example 3.

As the structure is exemplified by in construction views of FIGS. 4 to 6, in the three-dimensionally constructed warp knit fabric of the present invention, the insertion yarn on the guide bar L-2 is fixed along the inner portion of the back-surface ground knit construction on the guide bar L-1.

A fixing yarn (chained yarn) on the guide bar L-4 is knitted to strand over the connection yarns on the guide bar L-3, and the insertion yarn on the guide bar L-2 is fixed by the fixing yarn on the guide bar L-4 to the back-surface ground knit construction.

FIG. 1 is a schematic perspective view schematically showing a three-dimensionally constructed warp knit fabric.

The drawing shows a state where insertion yarns 5 (shown by single dotted chain lines) are each knitted along an inner portion of a back-surface ground knit construction of a three-dimensionally constructed warp knit fabric 1 in the wale direction.

A front-surface ground knit construction 2 has an open portion 6. The open portion 6 is easily formed in the manner that a yarn-draw-off portion is formed during lapping movement when the guide bar L-1 and the guide bar L-2 are used for knitting operation.

Figure 2:
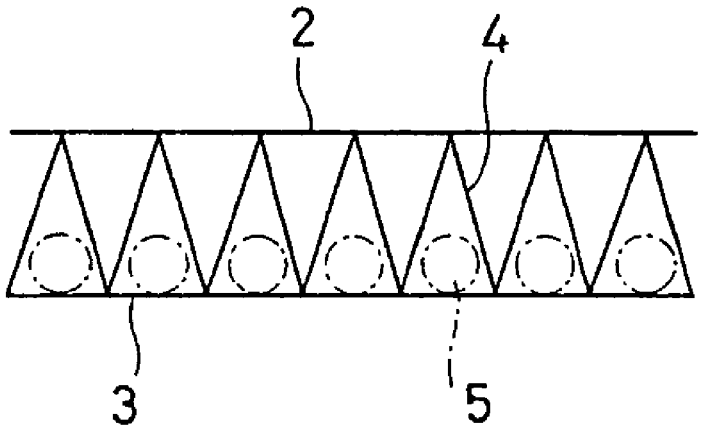
FIG. 2 is a schematic cross-sectional view of the three-dimensional warp knit taken along a course direction of FIG. 1.

FIG. 2 is a schematic cross-sectional view of the three-dimensional warp knit taken along the course direction of FIG. 1.

From the drawing, a state where the insertion yarn 5 is knitted along a back-surface ground knit construction 3 between connection yarns can be more clearly known.

In this state, a connection yarn 4 is supported by the insertion yarns 5 in the inner portion of the back-surface ground knit construction 3 with respect to the course direction.

Figure 3:
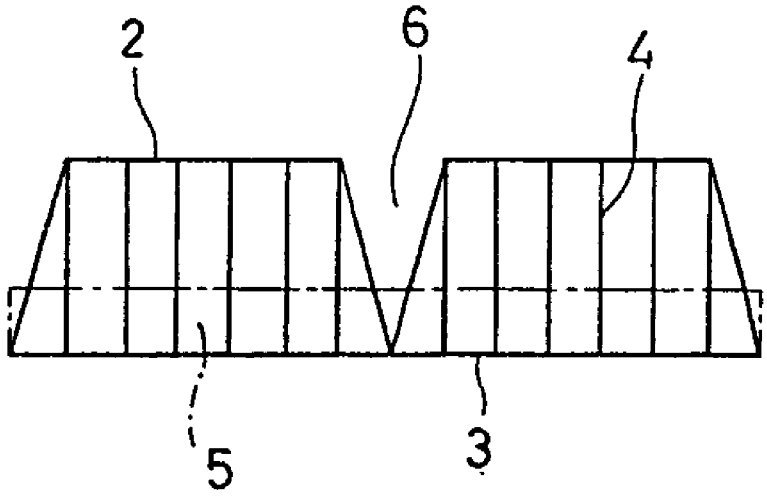
FIG. 3 is a schematic cross-sectional view of the three-dimensional warp knit taken along a wale direction of FIG. 1.

FIG. 3 is a schematic cross-sectional view of the three-dimensional warp knit taken along the wale direction of FIG. 1.

From the drawing, it can be understood that the insertion yarns 5 is knitted along the inner portion of the back-surface ground knit construction 3, and the insertion yarns 5 can be visually recognized through the open portion 6.

A state where the insertion yarn is fixed to the back-surface ground knit construction by the fixing yarn is not shown in FIGS. 1 to 3 (this state will be described below).

As shown in FIGS. 1 to 6, the three-dimensionally constructed warp knit fabric of the present invention has the construction in which the insertion yarn is fixed to the front-surface ground knit construction in the wale direction along the inner portion of the ground knit construction between the connection yarns knitted in the course direction, whereby the connection yarn is restrained.

For this reason, the connection yarns on the side of the back-surface ground knit construction are rendered not to be easily movable, and the connection yarns are rendered not to easily be congested with one another.

In the construction thus formed, high compressive elasticity is exhibited against a load in the thickness, and the connection yarns are rendered to be not easily collapsible. This consequently causes the front-surface and back-surface ground knit constructions not to be easily movable, so that the constructions high slippage preventability against pressure exerted from the course direction.

With reference to these drawings, description has been made regarding the case where the insertion yarns are inserted and fixed only in the wale direction. Of course, however, the insertion yarns may be knitted in both the wale direction and the course direction.

In the case where the insertion yarns are inserted and knitted only in the course direction, the state is such that the connection yarns are restrained by the insertion yarns in the inner portion of the back-surface ground knit construction with respect to the wale direction.

In addition, in a case where the insertion yarns are knitted in both directions, the ground knit constructions can be prevented from being misaligned when a load is exerted not only in the wale direction but also in the course direction.

The individual structures of the insertion yarns may be disposed between all the individual connection yarns or may be inserted at predetermined pitches.

For example, in the three-dimensionally constructed warp knit fabric shown in FIG. 1, the insertion yarns 5 may only be alternately knitted (with an insertion yarn a and an insertion yarn b, for example).

For the total fineness of one insertion yarn used in the present invention, a range of 167 dtex to 1400 dtex is preferably employed, and a range of 222 dtex to 990 dtex is more preferably employed.

When the total fineness is less than 167 dtex, the yarn is likely to distort, thereby making it difficult to sufficiently support the connection yarn. On the other hand, when the fineness is 1400 dtex or greater, the cloth texture can be excessively hard.

In the three-dimensionally constructed warp knit fabric of the present invention, the insertion yarn is fixed by the fixing yarn to the ground knit construction.

Figure 12:
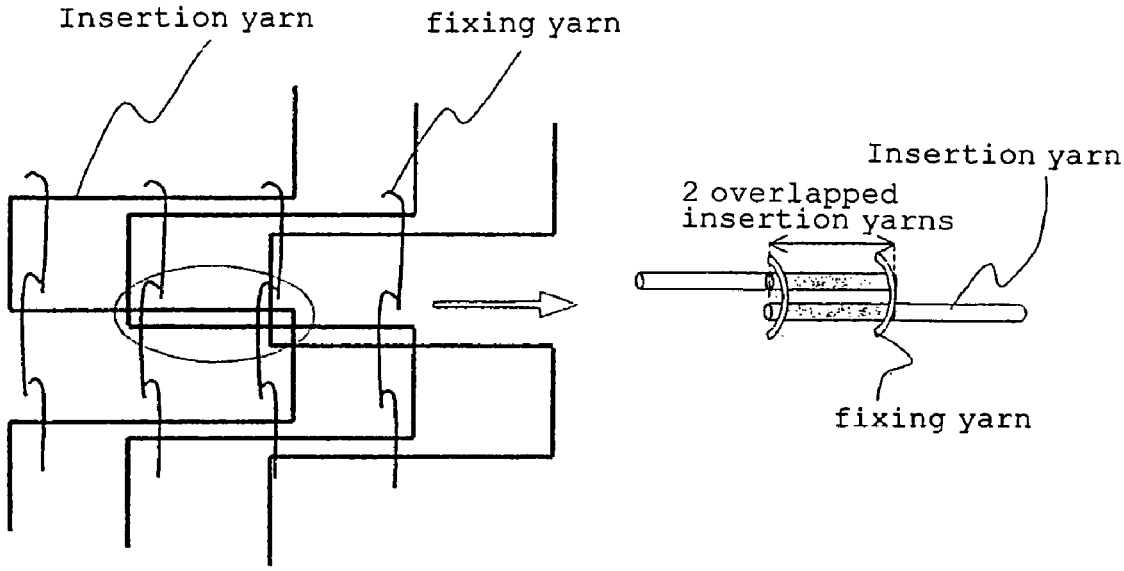
FIG. 12 is an explanatory view showing the relationship between an insertion yarn and a fixing yarn.

FIG. 12 is an explanatory view showing the relationship between the insertion yarn and the fixing yarn.

In the portion where the insertion yarns are fixed, the drawing shows that the insertion yarn is held by the fixing yarn, and there are overlap portions of two yarns (for the yarn arrangement, see the insertion yarn on the guide bar L-2 in the construction view of FIG. 4 and the fixing yarn on the guide bar L-4).

In this case, the number of overlapped insertion yarns is 2–6, and preferably 3–5; and the total fineness of the overlapped insertion yarns is preferably 334–8400 dtex, and more preferably 501–7000 dtex.

When the total fineness is less than 334 dtex, the yarns are likely to distort whereby making it difficult to sufficiently support the connection yarn. On the other hand, when the fineness is 8400 dtex or greater, the cloth texture can be excessively hard.

As the types of yarns for the insertion yarns, a multifilament yarn of composite textile of polyester or the like, a monofilament yarn, and a finished yarn and a spun yarn thereof may be used.

In addition, with ornamental yarns being used for the insertion yarns, a three-dimensionally constructed warp knit fabric can be formed that exhibits special ornamental characteristics with which the insertion yarns knitted along the inner portion of the back-surface ground knit construction can be visually recognized from the open portions of the front-surface ground knit construction and that has less slippage between the front-surface and back-surface ground knit constructions.

In addition, according to the three-dimensionally constructed warp knit fabric of the present invention, for an insertion density (insertion-yarn weight per unit volume of the three-dimensionally constructed warp knit fabric) to be calculated from expression 1 shown below, a range of 0.006–0.4 g/cm$^3$ is employed; and preferably, a range of 0.019–0.18 g/cm$^3$ is employed from the viewpoint of the pressure resistance and alignment preventability.

When the insertion density is lower than 0.006 g/cm$^3$, a case can occur in which the insertion yarn cannot sufficiently support the connection yarn, the pressure resistance deteriorates, and the alignment preventability deteriorates. On the other hand, the case where the insertion density is higher than 0.4 g/cm$^3$ is not preferable because there can occur a case where the texture is hard, air permeability deteriorates, and the texture mass increases.

$$\text{Insertion density} = S/10000T \quad (1),$$

where

S: amount of insertion yarn usage per 1 m$^2$ (g), and

T: thickness of the three-dimensionally constructed warp knit fabric (cm).

EXAMPLES

The present invention will be exemplified hereinbelow with reference to examples. However, the present invention is not limited to the examples.

Measurement methods used in the examples are as described hereunder.

Thickness Maintainability

Thickness-maintainability verification test materials having the size of 7 cm×7 cm, four pieces of the materials are stacked for easy identification of thickness verifications, and a 5 kg circular cylindrical weight having a diameter of 7 cm is placed on the top thereof.

In this state, the test materials were kept at 100° C. for two hours to expedite the thickness variation.

After two hours has passed, values were obtained from the expression "thickness maintainability (%)=L2/L1×100, where L2 represents a post-testing thickness immediately after removal of the weight, and L1 represents a thickness before the weight is placed.

○: Thickness maintainability=75% or higher

Δ: Thickness maintainability=70–75% or lower

X: Thickness maintainability=70% or lower

The thickness maintainability is an index representing the pressure resistance (compression resistance).

Alignment Preventability

Thickness-maintainability verification test materials having the size of 7 cm×7 cm, and a 5 kg circular cylindrical weight having a diameter of 7 cm is placed on the top thereof.

In this state, a microscope is used to photograph the states of connection yarns before and after a load is applied.

At this time, attention is drawn to one marked connection yarn, and the difference in slippage states of front-surface and back-surface ground knit constructions before and after the load is applied were photographed.

○: Connection yarn slippage width=75 mm or less

Δ: Connection yarn slippage width=7–10 mm or less

X: Connection yarn slippage width=10 mm or larger

Example 1

A double raschel knitting machine, KARL MAYER-made model RD6DPLM-77E-22G, was used to prepare a three-dimensionally constructed warp knit fabric as shown in a construction view of FIG. 4.

A back-surface ground knit construction was formed with a guide bar L-1, a front-surface ground knit construction having an open portion was formed with guide bars L-5 and L-6, and these constructions were connected using a connection yarn on a guide bar L-3. Then, an insertion yarn on a guide bar L-2 of 950 dtex was fixed using a fixing yarn on a guide bar L-4 along the ground-knit-construction inner portion opposite the open portion (i.e., inner portion of the back-surface ground knit construction). In this manner, the three-dimensionally constructed warp knit fabric with a finished density 36 courses: 23 wales, and a thickness of 3.0 mm was prepared.

The mass was 550 g/m$^2$.

The number of overlapped yarns between wales fixed with the insertion yarns was two, and the yarn size between the wales was 1900 dtex.

The insertion density was 0.096 g/cm$^3$.

The performance is shown in Table 1.

Example 2

The double raschel knitting machine, KARL MAYER-made model RD6DPLM-77E-22G, was used to prepare a three-dimensionally constructed warp knit fabric as shown in a construction view of FIG. 5.

A back-surface ground knit construction was formed with a guide bar L-1, a front-surface ground knit construction having an open portion was formed with guide bars L-5 and L-6, and these constructions were connected using the connection yarn on a guide bar L-3. Then, as insertion yarn on a guide bar L-2 of 1250 dtex was fixed using a fixing yarn on a guide bar L-4 along the inner portion of the back-surface ground knit construction. In this manner, the three-dimensionally constructed warp knit fabric with a finished density 36 courses: 23 wales, and a thickness of 3.0 mm was prepared.

The mass was 580 g/m$^2$.

The number of overlapped yarns between wales fixed with the insertion yarns was three, and the yarn size between the wales was 3750 dtex.

The insertion density was 0.196 g/cm$^3$.

The performance is shown in Table 1.

Example 3

The double raschel knitting machine, KARL MAYER-made model RD6DPLM-77E-22G, was used to prepare a three-dimensionally constructed warp knit fabric as shown in a construction view of FIG. 6.

A back-surface ground knit construction was formed with a guide bar L-1, an open-portion ground construction was formed with guide bars L-5 and L-6, and these constructions were connected using the connection yarn on a guide bar L-3. Then, an insertion yarn on a guide bar L-2 of 750 dtex was fixed using a fixing yarn on a guide bar L-4 along the inner portion of the back-surface ground knit construction. In this manner, the three-dimensionally constructed warp knit fabric with a finished density 36 courses: 23 wales, and a thickness of 3.0 mm was prepared.

The mass was 560 g/m$^2$.

The number of overlapped yarns between wales fixed with the insertion yarns was four, and the yarn size between the wales was 3000 dtex.

The insertion density was 0.173 g/cm$^3$.

The performance is shown in Table 1.

Example 4

Figure 7:
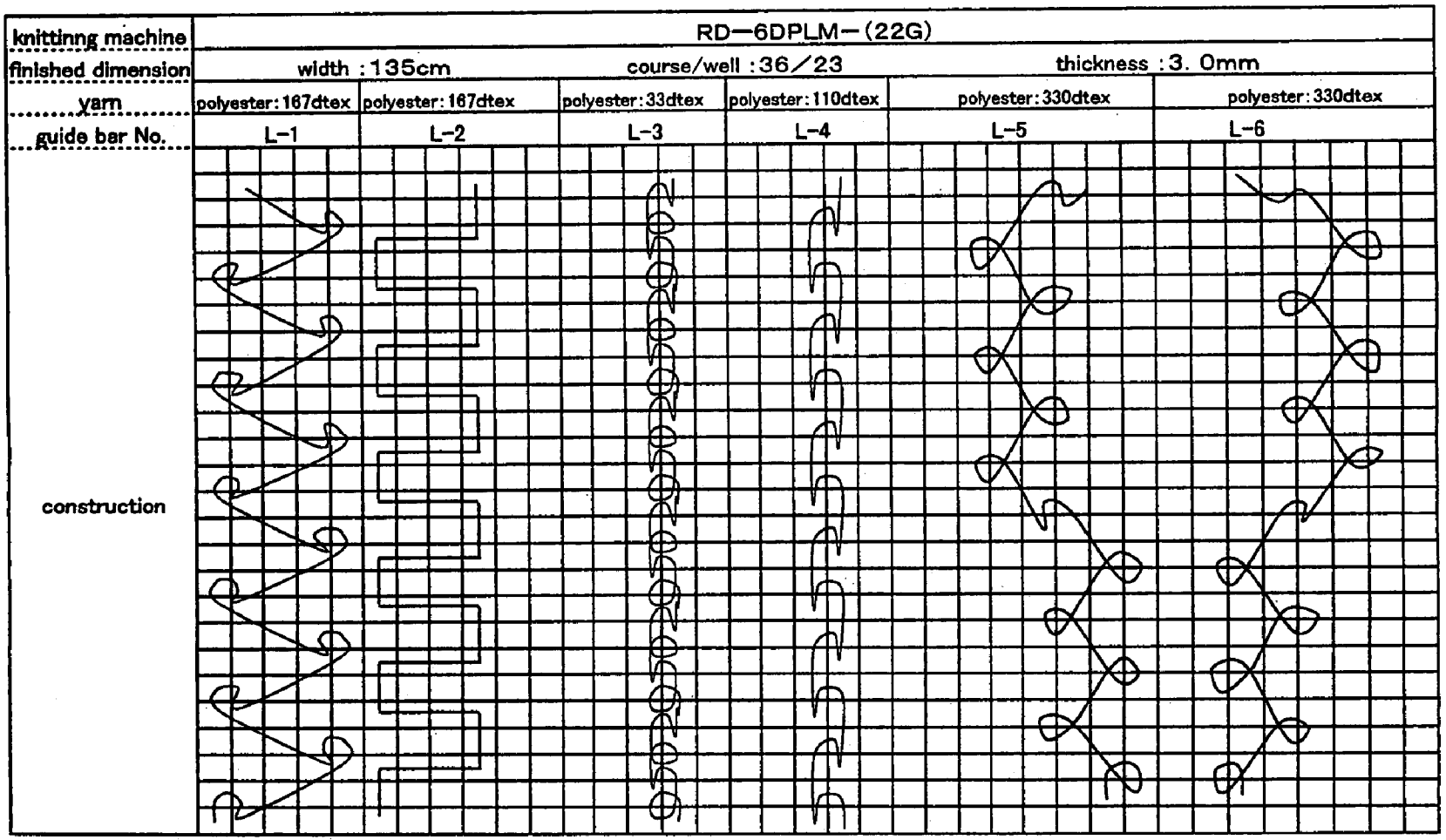
FIG. 7 is a construction view of a three-dimensionally constructed warp knit fabric of Example 4.

The double raschel knitting machine, KARL MAYER-made model RD6DPLM-77E-22G, was used to prepare a three-dimensionally constructed warp knit fabric as shown in a construction view of FIG. 7.

A back-surface ground knit construction was formed with a guide bar L-1, a front-surface ground knit construction having an open portion was formed with guide bars L-5 and L-6, and these constructions were connected using the connection yarn on a guide bar L-3. Then, an insertion yarn on a guide bar L-2 of 167 dtex was fixed using a fixing yarn on a guide bar L-4 along the ground-knit-construction inner portion opposite the open portion (i.e., inner portion of the back-surface ground knit construction). In this manner, the three-dimensionally constructed warp knit fabric with a finished density 36 courses: 23 wales, and a thickness of 3.0 mm was prepared.

The mass was 500 g/m$^2$.

The number of overlapped yarns between wales fixed with the insertion yarns was two, and the yarn size between the wales was 334 dtex.

The insertion density was 0.017 g/cm$^3$.

The performance is shown in Table 1.

Example 5

Figure 8:
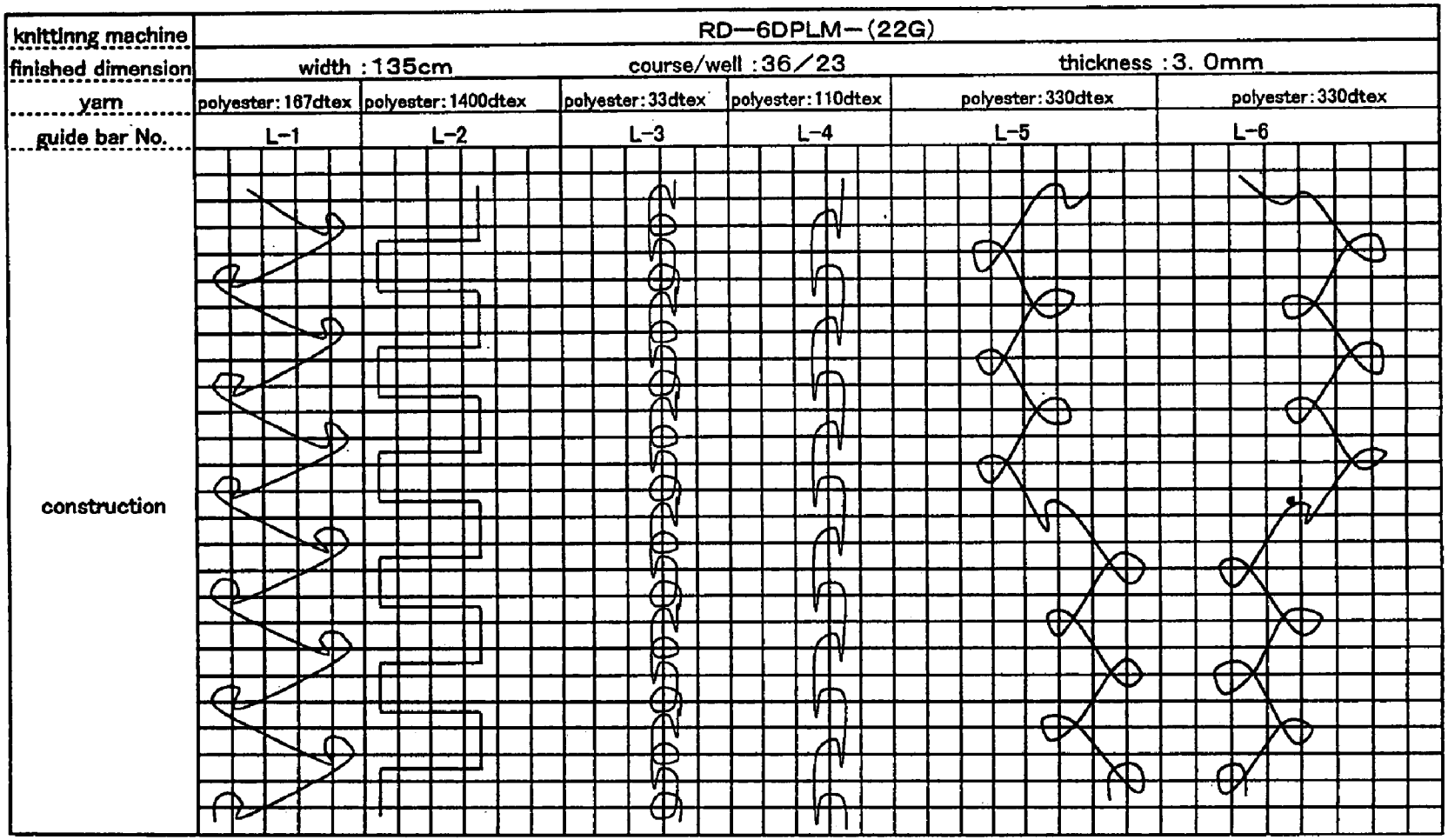
FIG. 8 is a construction view of a three-dimensionally constructed warp knit fabric of Example 5.

The double raschel knitting machine, KARL MAYER-made model RD6DPLM-77E-22G, was used to prepare a three-dimensionally constructed warp knit fabric as shown in a construction view of FIG. 8.

A back-surface ground knit construction was formed with a guide bar L-1, a front-surface ground knit construction having an open portion was formed with guide bars L-5 and L-6, and these constructions were connected using the connection yarn on a guide bar L-3. Then, an insertion yarn on a guide bar L-2 of 1400 dtex was fixed using a fixing yarn on a guide bar L-4 along the inner portion of the back-surface ground knit construction. In this manner, the three-dimensionally constructed warp knit fabric with a finished density 36 courses: 23 wales, and a thickness of 3.00 mm was prepared.

The mass was 600 g/m$^2$.

The number of overlapped yarns between wales fixed with the insertion yarns was four at maximum, and the yarn size between the wales was 5600 dtex.

The insertion density was 0.323 g/cm$^3$.

The performance is shown in Table 1.

Comparative Example 1

Figure 9:
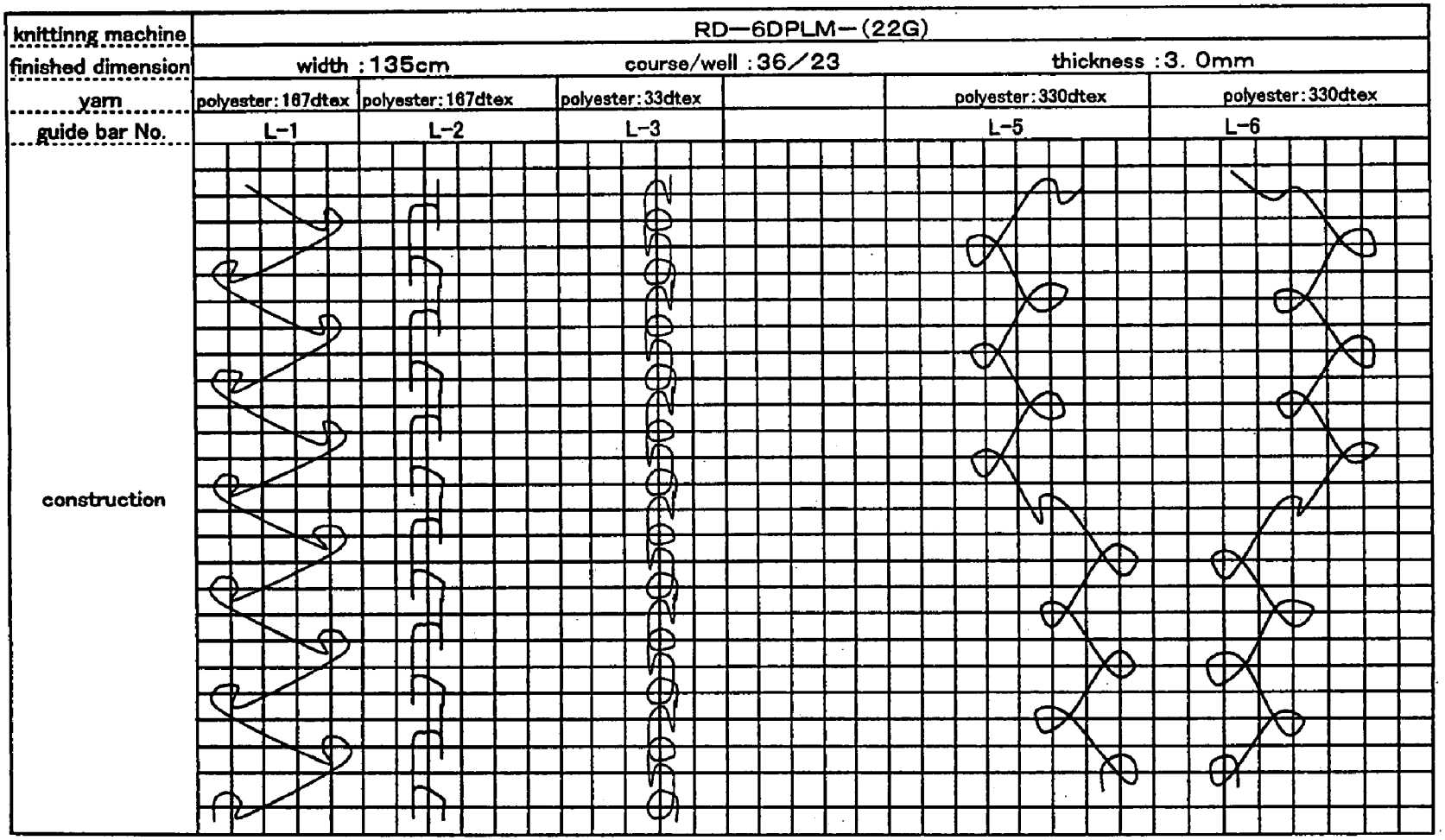
FIG. 9 is a construction view of a three-dimensionally constructed warp knit fabric of Comparative Example 1.

The double raschel knitting machine, KARL MAYER-made model RD6DPLM-77E-22G, was used to prepare a three-dimensionally constructed warp knit fabric as shown in a construction view of FIG. 9.

A back-surface ground knit and a front-surface group knit construction having an open portion were formed, and the constructions were connected with connection yarns. In this manner, the three-dimensionally constructed warp knit fabric with a finished density 36 courses: 23 wales, and a thickness of 3.0 mm was prepared.

The mass was 500 g/m$^2$.

The performance is shown in Table 1.

Comparative Example 2

Figure 10:
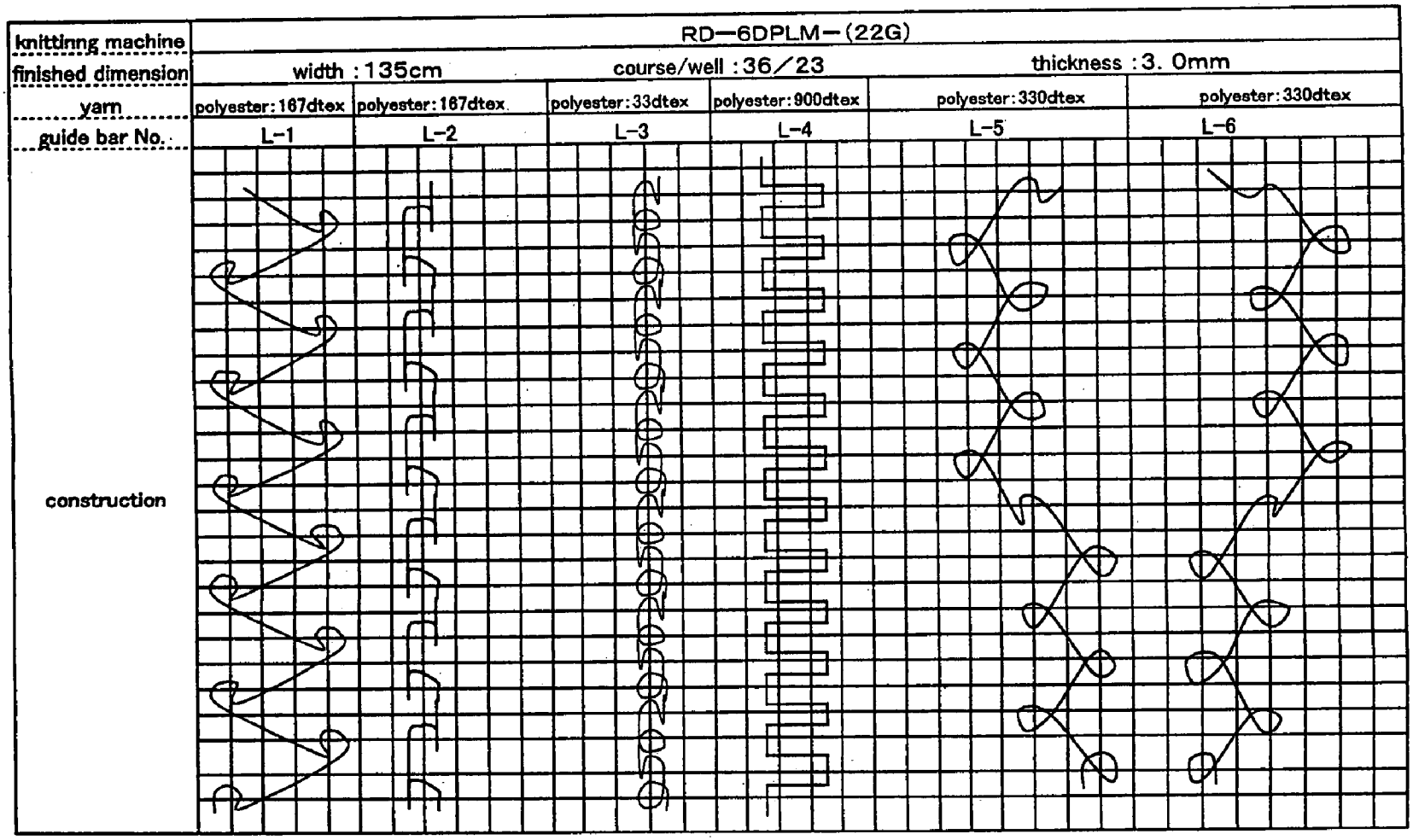
FIG. 10 is a construction view of a three-dimensionally constructed warp knit fabric of Comparative Example 2.

The double raschel knitting machine, KARL-MAYER-made model RD6DPLM-77E-22G, was used to prepare a three-dimensionally constructed warp knit fabric as shown in a construction view of FIG. 10.

A back-surface ground knit and a front-surface ground knit construction having an open portion were formed, and connection yarns of 900 dtex were inserted between connection yarns of the front-surface and back-surface ground knit constructions such as to float in substantially the center portion between the ground knit constructions. In this manner, the three-dimensionally constructed warp knit fabric with a finished density 36 courses: 23 wales, and a thickness of 3.0 mm was prepared.

The mass was 650 g/m$^2$.

The insertion density was 0.044 g/cm$^3$.

The performance is shown in Table 1.

TABLE 1

| | Insertion density | Thickness | Slippage width | |
|---|---|---|---|---|
| | (g/cm$^3$) | maintainability | Vertical | Horizontal |
| Example 1 | 0.096 | ○ | ○ | ○ |
| Example 2 | 0.196 | ○ | ○ | ○ |
| Example 3 | 0.173 | ○ | ○ | ○ |
| Example 4 | 0.017 | ○ | ○ | ○ |
| Example 5 | 0.323 | ○ | ○ | ○ |
| Comparative example 1 | — | X | X | X |
| Comparative example 2 | 0.044 | Δ | Δ | X |

As described above, the present invention can be modified without being limited by, for example, the embodiments and examples as long as the object is satisfied.

As long as the insertion yarns in the three-dimensionally constructed warp knit of the present invention are fixed along the inner portion of the back-surface ground knit construction whereby to enable slippage of the connection yarns in the course and/or wale directions to be prevented, the types thereof may be modified.

EFFECTS OF THE INVENTION

The three-dimensionally constructed warp knit fabric of the present invention is formed to include two front-surface and back-surface ground knit constructions and connection yarns interconnecting the two front-surface and back-surface ground knit constructions employs the construction comprising insertion yarns between the connection yarns, wherein the insertion yarn is fixed along the inner side of the back-surface ground knit construction. Accordingly, bending and congestion occurrences when, for example, the construction is compressed can be prevented as much as possible, elasticity deterioration due to congestion between bent connection yarns can be prevented, and inclination of the connection yarns can be prevented.

As such, even upon reception of a force in the course direction or the wale direction depending on the insertion direction of the insertion yarns, the three-dimensionally constructed warp knit fabric of the present invention can effectively prevent the ground knit constructions from being misaligned in the wale direction or the course direction.

In addition, the insertion yarn is required only to be fixed along the inner portion of the back-surface ground knit construction. Consequently, the three-dimensionally constructed warp knit fabric can be formed to have the capability of restraining an increase in the cloth mass, which is caused due to the use of a plurality of insertion yarns in the thickness direction as in the conventional case, and to have pressure resistance and excellent alignment preventability between the ground knit constructions.

INDUSTRIAL APPLICABILITY

The present invention relates to a three-dimensionally constructed warp knit fabric used as a material, such as a cushion material and a filler material, in clothing fields; and more particularly, as a material such as a vehicle seat material in industrial material fields. However, without departing from the principle of the present invention, the invention may be applied to a wide range of industrial fields of, for example, construction-work dedicated seats and medical dedicated seats.

The invention claimed is:

1. A three-dimensionally constructed warp knit fabric formed to include front-surface and back-surface ground knit constructions and connected yarns interconnecting the front-surface and back-surface ground knit constructions, the three-dimensionally constructed warp knit fabric being characterized by comprising an insertion yarn inserted between the connection yarns, wherein the insertion yarn is fixed by a fixing yarn along an inner side of the back-surface ground knit construction.

2. A three-dimensionally constructed warp knit fabric of claim 1, characterized in that the insertion yarn is inserted in at least one of a course direction and a wale direction.

3. A three-dimensionally constructed warp knit fabric of claim 1, characterized in that in a portion where the insertion yarn is fixed by a fixing yarn, the number of overlapped insertion yarns is 2–6 and a total fineness of all the overlapped insertion yarns is 334–8400 dtex.

4. A three-dimensionally constructed warp knit fabric of claim 1, characterized in that an insertion density of the insertion yarn, shown by expression 1, is 0.006–0.4 g/cm$^3$, wherein $$\text{insertion density} = S/10000T \quad (1)$$

where

S: amount of insertion yarn usage per 1 m$^2$ (g), and

T: thickness of the three-dimensionally constructed warp knit fabric (cm).

5. A manufacturing method for a three-dimensional warp knit fabric formed to include front-surface and back-surface ground knit constructions and connection yarns interconnecting the front-surface and back-surface ground knit constructions, comprising the steps of inserting an insertion yarn between the connection yarns and fixing the insertion yarn by fixing yarns along an inner side of the back-surface ground knit construction.

* * * * *